US006866539B2

(12) United States Patent
Chang

(10) Patent No.: US 6,866,539 B2
(45) Date of Patent: Mar. 15, 2005

(54) HIGH FREQUENCY CONNECTOR

(75) Inventor: Che-Chia Chang, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 10/372,282

(22) Filed: Feb. 25, 2003

(65) Prior Publication Data

US 2004/0121647 A1 Jun. 24, 2004

(30) Foreign Application Priority Data

Dec. 18, 2002 (TW) ..... 91220551

(51) Int. Cl.[7] ..... H01R 13/58
(52) U.S. Cl. ..... 439/460; 439/610
(58) Field of Search ..... 439/460, 610, 439/609, 464, 470, 452, 877, 585

(56) References Cited

U.S. PATENT DOCUMENTS 3,387,080 A * 6/1968 Charles et al. ..... 174/94 R
5,199,903 A * 4/1993 Asick et al. ..... 439/610
5,380,223 A * 1/1995 Marsh et al. ..... 439/610
5,658,170 A * 8/1997 Tan et al. ..... 439/610
5,820,412 A * 10/1998 Koegel et al. ..... 439/610
6,139,365 A * 10/2000 Lok ..... 439/607
6,659,801 B2 * 12/2003 Nishio et al. ..... 439/610

* cited by examiner

*Primary Examiner*—Ross Gushi
(74) *Attorney, Agent, or Firm*—Troxell Law Office, PLLC

(57) ABSTRACT

A high frequency connector is used for connecting with a high frequency transmission cable as to offer a function of transmitting signal of an electric appliance. The high frequency connector includes an insulation body with multiple terminal therein, a metal inner covering disposed at outer side of the insulation body and a jacket disposed at the outermost side of the connector. The terminals are electrically connected to the cable and the inner cover at an end thereof has a locating device for holding the cable. The locating device is provided with an engaging device so as to retain and hold the cable at a preset position without loosening and swaying such that both high frequency characteristics and integral strength of the connector can be enhanced.

11 Claims, 5 Drawing Sheets

HIGH FREQUENCY CONNECTOR

BACKGROUND OF THE INVENTION

1. Field of the Invention

The present invention relates to a high frequency connector and particularly to a high frequency connector used with electrical equipment.

2. Description of Related Art

Due to the core technology for operation and processing in a computer system upgrading incessantly, the net information service being incessantly promoted and data density growing multiply, it not only brings internal revolution of the computer but also makes the transmission frequency width and storage capacity of the computer peripheries rising suddenly.

For the data storage equipment, it plays an important role in a structure of computer system for saving programs, files and various data. Owing to the internal transmission speed and the information storage capacity being enhanced, the external interface transmission specification of the data storage equipment has to be upgraded such that it is capable of providing the hard disk enough frequency width for completing effective input and output.

In order to meet the required frequency width, the data storage equipment has progressed the interface specification such as Ultra ATA, Ultra ATAS/66, Ultra ATA/100 or Ultra ATA/133, in recent years. Currently, the Serial ATA has be regulated as a cable standard for a highest transmission frequency width and problems faced with the production technique are getting more if the frequency width of the cable line is getting higher.

The serial ATA has been developed with a set of serial transmission pair as a signal transmission passage instead of the traditional design of parallel wiring. Presently, the connector mainly has an insulation body with multiple terminals therein for electrically connecting with the cable and the insulation body at the outer side thereof is a jacket, which is made of plastics with injection molding directly. However, problems, which have to be solved, resided in the preceding fabrication way are listed hereinafter:

1) The cable is unable to be fixed easily: Because the high frequency transmission cable is pretty sensitive to the range difference of signal between the serial transmission pairs such that it may result in mistakes during signal transmission in case of the cable line having any turn or bent. Especially, the cable at the position for joining the connector is frequently incapable of meeting the standard frequency width due to internal lines of the cable misaligning caused by the factor of fabrication work.

2) It is interfered by the magnetic field easily: Although the current used high frequency transmission cable is provided with a ground line therein, there is no any electromagnetic screening device available at the outer side of the connector so that the joint of the connector may be interfered by the external electromagnetic field and generate noisy signal to reduce the quality of transmission.

3) Insufficient holding force is provided: At the present time, the connector is provided with terminals extending outward such that the terminals and an oppositely joined connector interfere with each other to form a major holding force. However, the preceding holding structure is incapable of complying with the contact situation of inserting and taking out frequently and it is quite easy to become insufficient holding force due to elastic fatigue of the terminals.

In this way, a serious consequence such as signal breaking out will occur because of connector loosening.

4) The engaging device is lack of firmness: The conventional connector at the joining surface thereof is made of plastics and the plastics provides low hardness so that the conventional connector can keep firm only in case of the connector being inserted to engage with the opposite joining connector and being taken out to disengage from the opposite joining connector less frequently. If the connector is used under the condition of being inserted and taken out frequently, the part made of plastics may fracture and the connector becomes useless.

SUMMARY OF THE INVENTION

A primary object of the present invention is to provide a high frequency connector, which can locate the cable firmly, so as to avoid the cable being bent and misaligned during the connector being made and enhance the high frequency characteristics of the connector.

Another object of the present invention is to provide a high frequency connector, with which the electromagnetic interference can be screened out, the engaging device can be intensified and the joining force thereof can be increase, so that the integral strength thereof and the effect for protecting from the electromagnetic can be enhanced substantially.

Accordingly, the high frequency connector according the present invention includes an insulation body providing multiple terminals connected to the cable, a metal inner covering disposed at the outer side of the insulation body with an end thereof extending a locating device for holding the cable and the locating device having an engaging device for fastening the cable, and a jacket extending from the connecting section of the insulation body to cover the insulation body, the metal inner covering and part of the cable. Hence, the cable can keep at a preset position due to the locating device of the inner covering and can avoid loosening and swaying due to the engaging device in the locating device such that the integral strength of the high frequency connector can be enhanced.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
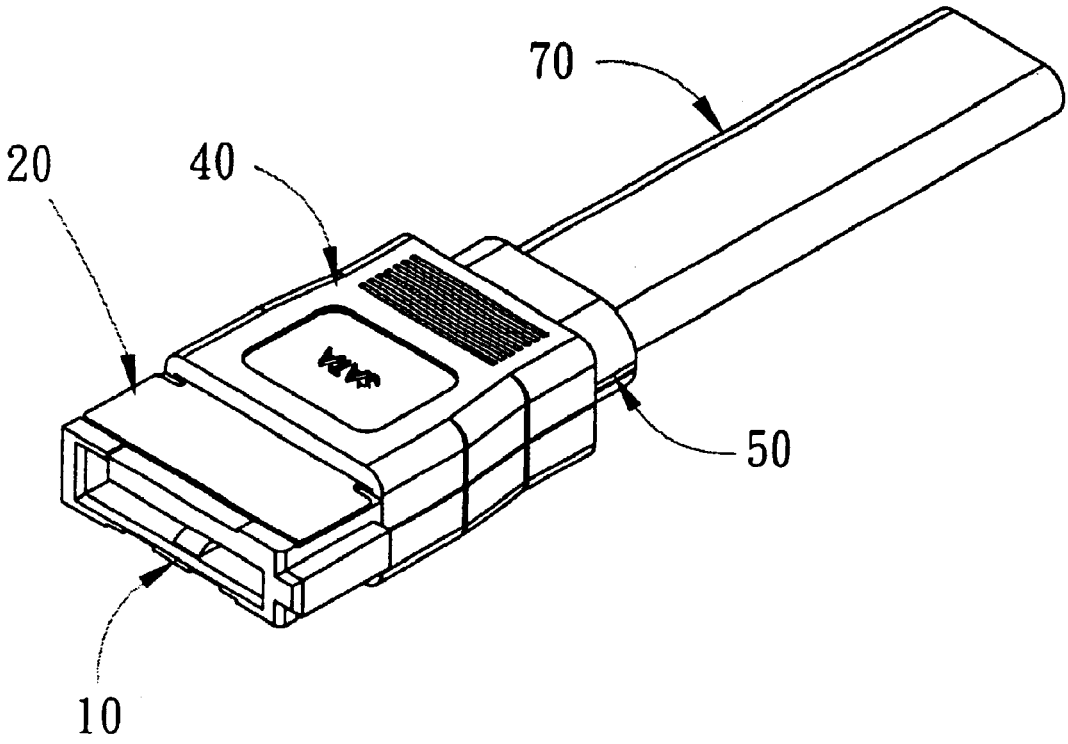
FIG. 1 is a perspective view of a high frequency connector according to the present invention.
Figure 2:
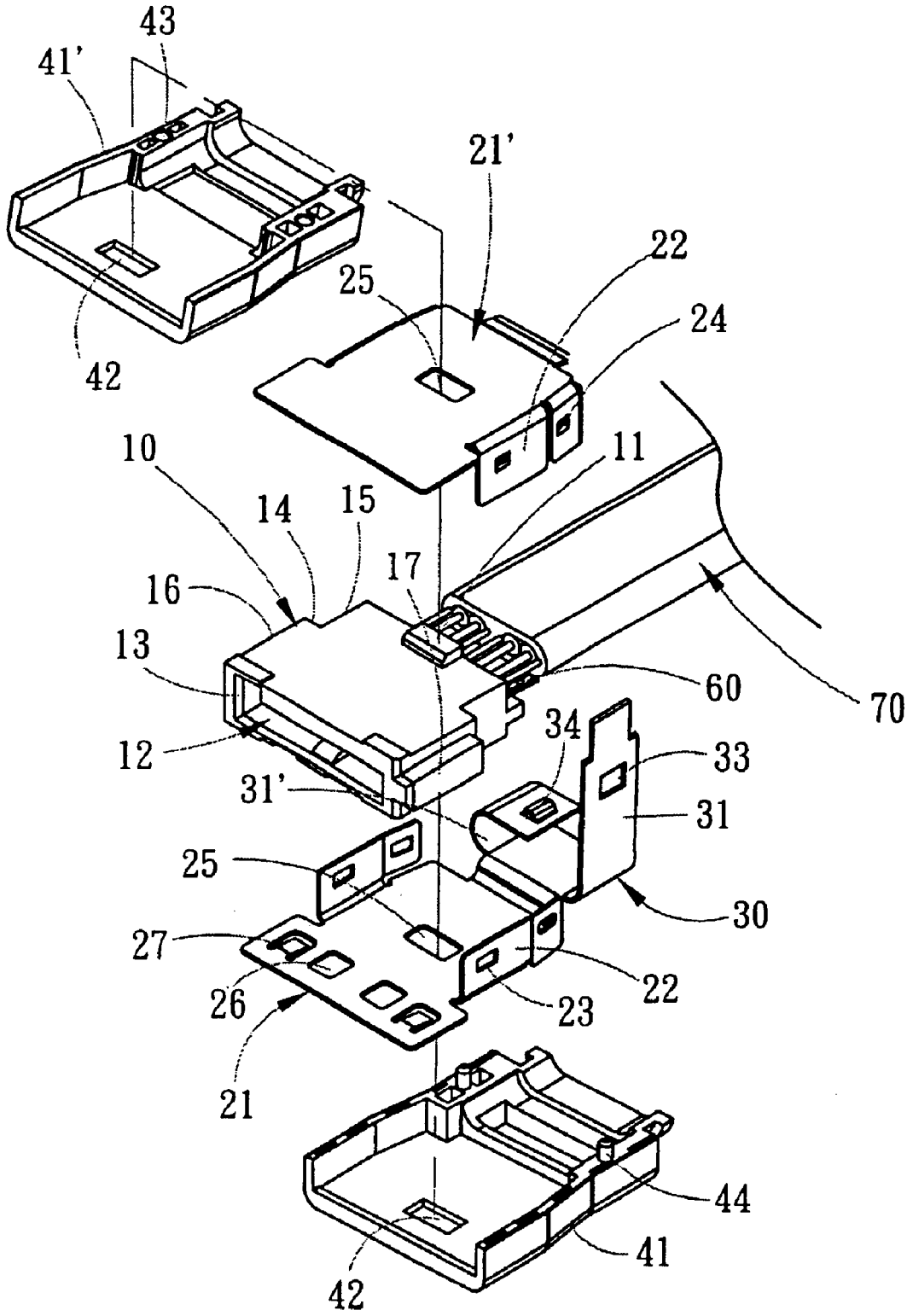
FIG. 2 is an exploded perspective view of the high frequency connector shown in FIG. 1.
Figure 3:
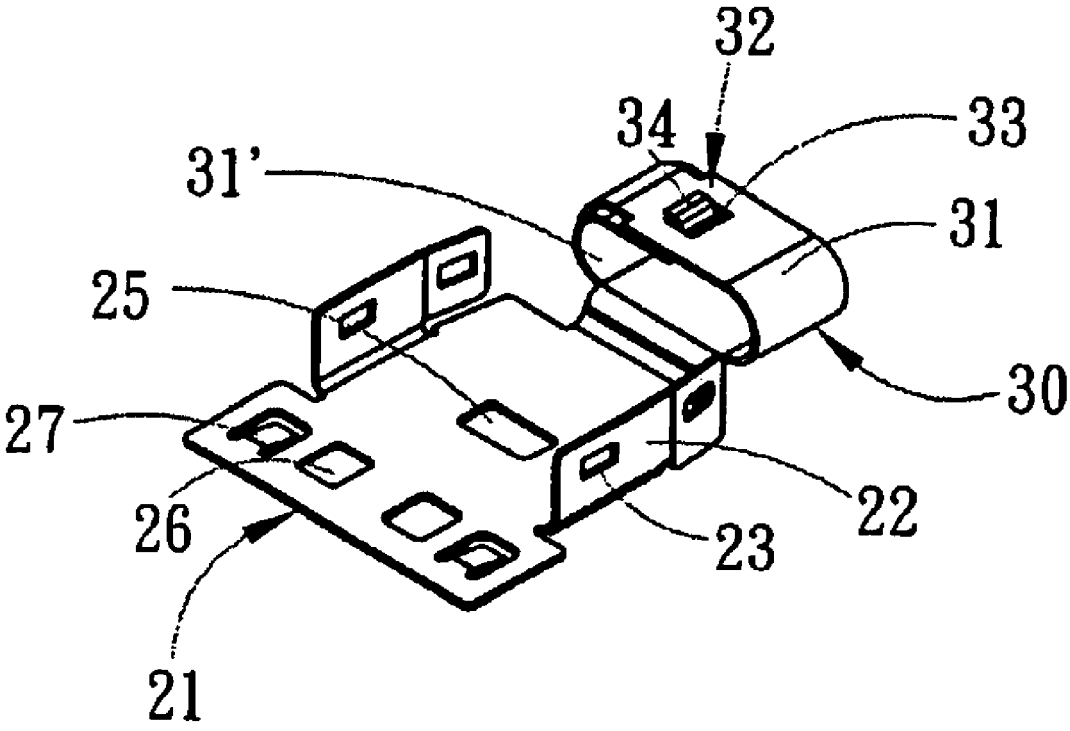
FIG. 3 is a perspective view of a locating device for a covering body in the high frequency connector according to the present invention in a state of engagement.

Referring to FIGS. 1 and 2, a high frequency connector according to the present invention is connected to a high frequency transmission cable 70 to transmit electrical signals and the high frequency connector includes an insulation body 10 with multiple terminals 60, an inner metal covering 20 disposed at the outer side of the insulation body 10 and a jacket 40 disposed at the outermost part of the connector. The terminals 60 in the insulation body 10 electrically connects with the cable 70 and the inner covering 20 at an end thereof has a locating device 30 for holding the cable 70 as shown in FIG. 3. The locating device 30 has an engaging device 32 for securing the cable 70 and the locating device 30 with the inner covering 20 thereof can keep the cable 70 at a preset position and prevent the cable 70 from loosening and swaying. Thus, the cable with bent and misaligning resulting from the connector being fabricated can be avoided so that it is capable of intensifying the high frequency characteristics of the connector and strengthening the connector.

The insulation body 10 primary has a receiving groove 12 for accommodate the terminals 60 and allowing the terminals 60 passing through the insulation body 10 and has at least an abrupt block 11 on the surface thereof. The insulation body 10 extends a reduced joint 14 and the reduced joint 14 divides the insulation body 10 into a wiring section 15 and an inserted section 16. The receiving groove 12 corresponding to the inserted section 16 forms an inserted opening 13 and the inserted section 16 at a lateral side thereof has a foolproof post 17. Thus, the inserted section 16 and the inserted opening 13 constitutes a structure corresponding to an opposite joining connector 80 and it is possible to distinguish the inserted direction of the opposite joining connector 80 by way of the foolproof post 17 to avoid a careless insertion done by the user.

The covering 20 is composed of a set of metal thin plates and includes two metal shells 21, 21' and the locating device 30 is extended from one of the metal shells 21, 21' corresponding to an end of the wiring section 15 on the insulation body. The metal shells 21, 21' at both lateral sides thereof have a lateral wall 22 respectively corresponding to the wiring section 15 of the insulation body 10 with lock holes 23 provided at the lateral walls 22 of the metal shell 21 corresponding to lock tabs 24 provided at the lateral walls 22 of the metal shell 21' such that the metal shells 21, 21' can be engaged to each other. Further, the metal shells 21, 21' have a piercing hole 25 corresponding to the abrupt block 11 and each of the metal shells 21, 21' provides at least a fitting hole 26 to fit with the connector 80 in a way of interfering with each other and provides at least a ground plate 27 for contacting with a ground device of the connector 80. Hence, the tightness between the high frequency connector and the connector 80 can be enhanced with the aid of the interfering fitting hole 26 and the effect of electromagnetic protection of the entire connector can be enhanced by way of the ground plate 27.

Besides, the locating device 30 includes two holding wings 31, 31' for enclosing the circumferential surface of the cable 70 and the engaging device 32 is disposed at the free end of each of the holding wings 31, 31' with one of the free ends having a lock hole 33 and the other free end having a lock piece 34 so that the lock hole 33 can engage with the lock piece 34 to define the position of the cable 70 with respect to the covering 20 so as to facilitate subsequent assembling operations and secure the cable 70 from being bent and misaligned.

The jacket 40 extends from the reduced joint 14 of the insulation body 10 toward the cable 70 and covers the insulation body 10, the inner covering 20 and part of the cable 70. The jacket 40 includes two outer casing halves 41, 41' with one of the inner sides thereof having an engaging blind hole 43 and the other one of the inner sides thereof having an engaging post 44 so that the two outer casing halves 41, 41' can be attached to each other oppositely. Further, the outer casing halves 41, 41' at the inner sides thereof have a locating recess 42 respectively for receiving the abrupt block 11 of the insulation body 10 so that the abrupt block 11 can pass through the piercing hole 25 and enter the locating recess 42 to restrain positions of the insulation body 10, the inner covering 20 and the jacket 40 relatively.

Firstly, the cable 70 is pulled in a straight state without bending before the connector of the present invention being made. Then, the cable 70 is welded to the terminals 60. Next, the piercing holes 25 at the metal shells 21, 21' are aligned to the abrupt block 11 and to be mounted at two lateral sides of the insulation body 10. Right at this time, the lock tabs 24 on the lateral wall 22 of the metal shell 21 fall into the lock holes 23 so that the two metal shells 21, 21' can cover the insulation body 10. Afterward, referring to FIGS. 2 and 3, the holding wings 31, 31' of the locating device 30 on the metal shells 21, 21' are bent along the circular surface of the cable 70 so as to join the engaging device 32 provided at the ends of the holding wings 31, 31' such that the lock piece 34 can fall into the retaining hole 33 to define the position of the cable 70 relative to the inner covering 20 to facilitate the subsequent operations for assembling the connector of the present invention and secure the cable 70 from bending and misaligning so as to maintain the high frequency characteristics thereof. Finally, the jacket 40 is made with the locating recesses 42 at the inner sides thereof aligning with the abrupt block 11 and the engaging hole 43 aligns with the engaging post at two lateral sides of the inner sides respectively. Because the locating recess 42 corresponds to the abrupt block 11, the outer casing halves 41, 41' extend from the reduced joint 14 just rightly to cover the insulation body 10, the inner covering 20 and part of the cable 70. The two outer casing halves 41, 41' are treated with high frequency seaming after having reached the preset position so that the outer casing halves 41, 41' can join with each other as an integral piece and the high frequency connector can be obtained.

Wherein, the jacket 40 is made with injection molding directly after the step of enclosing with the metal shells 21, 21'. The jacket 40 at the end section thereof is provided with a locating sleeve 50 as shown in FIG. 1 can absorb the bending force of the cable 70 and the locating sleeve 50 is formed with injection molding.

Figure 4:
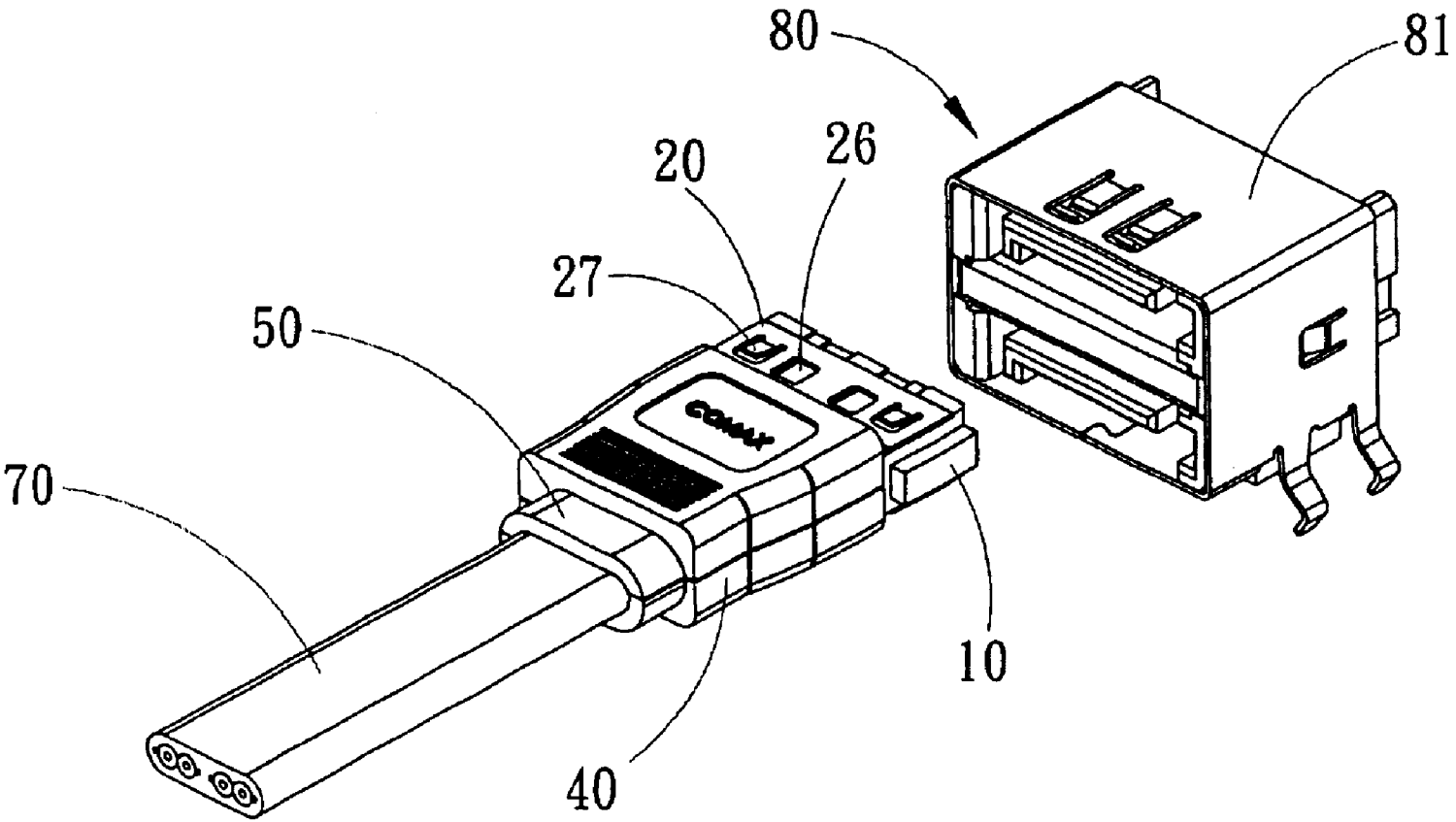
FIG. 4 is a perspective view illustrating the connector in the first state of use.
Figure 5:
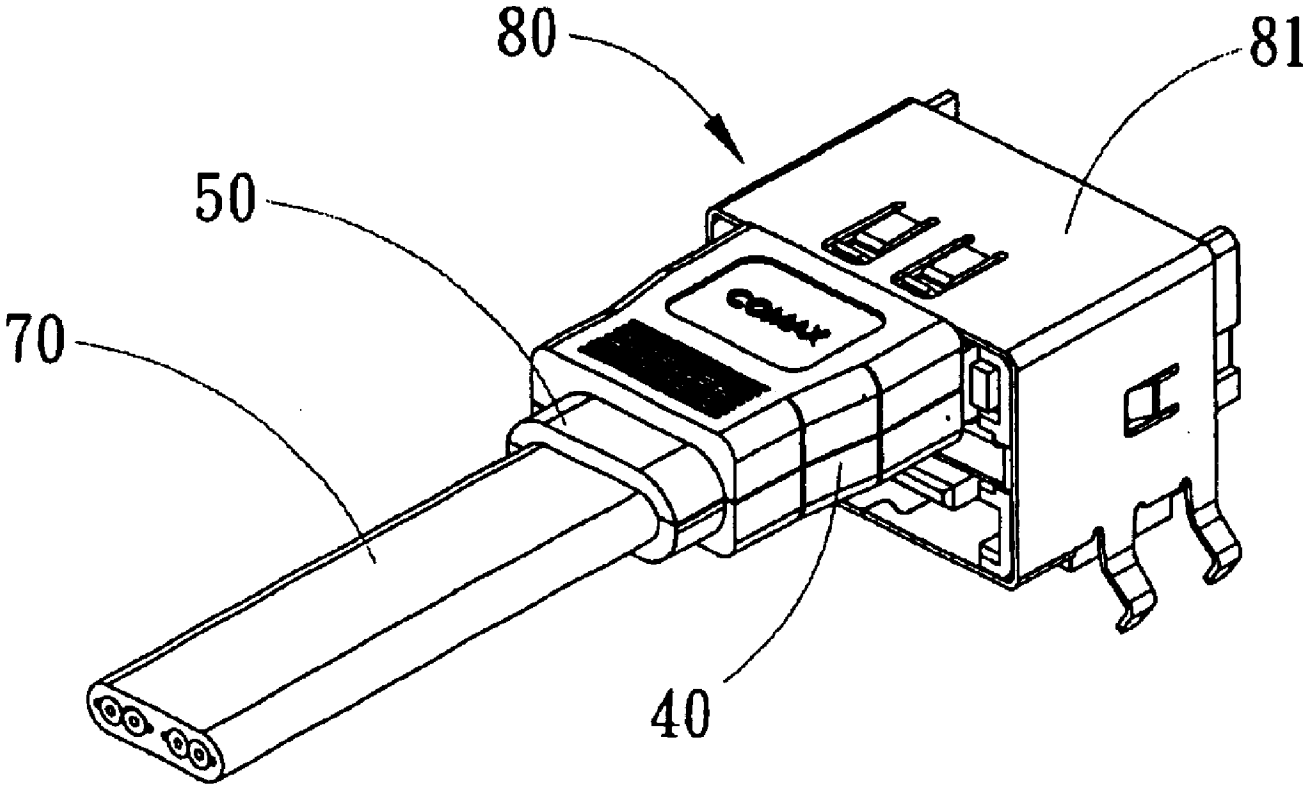
FIG. 5 is a perspective view illustrating the connector in the second state of use.

Referring to FIGS. 4 and 5, while the high frequency connector of the present invention is in use, the opposite joining connector 80 at the outer side thereof has a shield shell 81 and the high frequency connector of the present invention is connected to the connector 80 by way of the inserted section 16 o the insulation body 10 with the interfering fitting hole 26 at the metal shell 21 engaging with the connector 80 during swapping so as to intensify the inserting or detaching force. In addition, the ground plate 27 on the metal shell 21 can contact with the shield 81 of the connector 80 to obtain the effect of integral electromagnetic protection.

It is appreciated that the high frequency connector according to the present invention can locate the cable 70 firmly by way of locating device to prevent the cable 70 from bending and misaligning so as to enhance the high frequency characteristics of the present invention and constitute a screen of electromagnetic interference. Furthermore, the joining structure of the connector can be intensified to enhance the engaging force so that the integral strength of the connector can be enhanced and the effect of electromagnetic protection can be promoted substantially.

While the invention has been described with reference to a preferred embodiment thereof, it is to be understood that modifications or variations may be easily made without departing from the spirit of the invention, which is defined in the appended claims.

What is claimed is:

1. A high frequency connector connected to a cable for transmitting a signal of an electric appliance comprising:

a) an insulation body having a plurality of terminals connected to a first end of the cable;

b) a metal inner covering located on an exterior of the insulation body and having first and second metal shells, the first and the second metal shells each having lateral side walls located on opposing sides thereof and a connecting device connecting the first and the second metal shells together;

c) a locating device extending from one of the first and second metal shells and holding the cable, the locating device having an engaging device fastening the locating device to the cable; and d) a jacket covering the insulation body, the metal inner covering, and the first end of the cable, wherein the insulation body includes at least one abrupt block, the metal inner covering includes at least one piercing hole, and the jacket includes at least one locating recess, the at least one abrupt block aligning with and inserted through the at least one piercing hole of the metal inner covering and inserted into the at least one locating recess of the jacket, wherein the insulation body includes a receiving groove into which the plurality of terminals are inserted, a reduced joint located along the receiving groove and dividing the insulation body into an inserted section and a wiring section, the inserted section protruding from the jacket and having an inserting opening and a fool proof post, the fool proof post is located on a lateral side of the insert section on an exterior of the high frequency connector corresponding with an opposite joining connector, the engaging device is located within the jacket and includes a second lock hole on a first end of the first holding wing and a lock piece on a first end of the second holding wing, the lock piece engaging the second lock hole.

2. The high frequency connector according to claim 1, wherein the connecting device includes a plurality of lock tabs located on the lateral side walls of the first metal shell, a plurality of first lock holes located on the lateral side walls of the second metal shell, each of the plurality of lock tabs aligning with and engaging one of the plurality of first lock holes.

3. The high frequency connector according to claim 1, wherein the jacket extends from the reduced joint towards the first end of the cable and is located around the wiring section.

4. The high frequency connector according to claim 1, wherein the metal inner covering includes at least one interfering fitting hole engaging the opposite connector, such that the inserted section of the insulation body is located in the opposite connector.

5. The high frequency connector according to claim 1, wherein the metal inner covering includes at least one ground plate engaging a ground device of the opposite connector.

6. The high frequency connector according to claim 1, wherein the metal inner covering is made from metal plates.

7. The high frequency connector according to claim 1, wherein the jacket is made with injection molding.

8. The high frequency connector according to claim 1, wherein the jacket includes first and second outer casing halves.

9. The high frequency connector according to claim 8, wherein the first and the second outer casing halves are joined by ultrasonic plastic welding.

10. The high frequency connector according to claim 8, wherein the first outer half includes a plurality of engaging holes, the second outer casing half includes a plurality of engaging posts, each of the plurality of engaging posts aligning with and engaging one of the plurality of engaging holes.

11. The high frequency connector according to claim 1, wherein the jacket includes a locating sleeve located around the first end of the cable.

* * * * *